US006425256B1

(12) United States Patent
Bushnell et al.

(10) Patent No.: US 6,425,256 B1
(45) Date of Patent: Jul. 30, 2002

(54) MOLDED PLASTIC BASEPAN FOR A ROOM AIR CONDITIONER

(75) Inventors: Peter R. Bushnell, Cazenovia, NY (US); Nestor Hernandez, Monterrey (MX); Juan C. C. Correa, Porto Alegre (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,235

(22) Filed: Aug. 17, 2000

(51) Int. Cl.[7] ..... F25D 23/12
(52) U.S. Cl. ..... 62/262; 62/259.1
(58) Field of Search ..... 62/259.1, 262, 62/263

(56) References Cited

U.S. PATENT DOCUMENTS 3,724,233 A * 4/1973 Pugh et al. ..... 62/262
4,641,502 A * 2/1987 Aldrich et al. ..... 62/244
4,970,875 A * 11/1990 Kim ..... 62/272
5,532,435 A * 7/1996 Bolton et al. ..... 174/135
5,638,693 A * 6/1997 Baek ..... 62/262
5,697,227 A * 12/1997 Bruce et al. ..... 62/259.1
5,732,565 A * 3/1998 Ramakrishnan et al. ..... 62/262

* cited by examiner

*Primary Examiner*—William E. Tapolcai
*Assistant Examiner*—Mohammad M Ali

(57) ABSTRACT

A molded plastic basepan supporting components of a room air conditioner includes a substantially rectangular bottom wall having a front edge, a back edge and left and right side edges. The bottom defines a top surface and bottom surface, and each of the edges thereof includes a structural side wall section extending upwardly therefrom in a direction substantially perpendicular to the bottom wall. A vertically extending substantially hollow structural beam is formed in the bottom wall of the basepan. The structural beam extends laterally from a location proximate the left side wall to a location proximate the right side wall. In a preferred embodiment, the bottom surface of the bottom wall is substantially planar and the structural beam is defined by a closed elongated channel extending upwardly into the basepan to define an elongated enclosed wall extending upwardly from the top surface of the bottom wall.

7 Claims, 7 Drawing Sheets

MOLDED PLASTIC BASEPAN FOR A ROOM AIR CONDITIONER

BACKGROUND OF THE INVENTION

The present invention is directed to air conditioners and, more particularly, to a one-piece injection molded plastic basepan having a high level of structural integrity.

It has been a common practice to provide a basepan for a room air conditioner unit fabricated of metal and including various structural elements needed for rigidity and strength. Such basepans are not only subject to corrosion by the condensate drain water, but are also costly and expensive to fabricate while adding to the total weight of the unit. Air conditioners using such basepan also typically have a number of other metal structural components attached to the basepans which require a plurality of fasteners to facilitate attachment thereto, thus requiring additional parts and additional labor input to fabrication of the unit, all resulting in higher costs.

U.S. Pat. No. 3,724,233, "Molded Plastic Basepan For Room Air Conditioner" to Pugh et al. describes an integrally molded synthetic basepan for an air conditioning unit which includes molded in features for handling condensate flow. The '233 patent does not address the design or manufacture of a basepan having high structural integrity. Such a high level of structural integrity is necessary in such air conditioning units in that the compressors mounted in all such units are extremely heavy. Further, the size of such units requires rigidity to prevent distortion of the basepan and the components supported thereby during handling of the air conditioning unit.

U.S. patent application Ser. No. 09/140,007, "Window Room Air Conditioner", assigned to the assignee of the present invention, relates to a window room air conditioning having a rectangular basepan and having the components thereof assembled into subassemblies. A first subassembly includes the evaporator coil, condenser coil and compressor and the usual refrigerant interconnections therebetween. This subassembly is initially assembled within the basepan. The second subassembly referred to as the "air handling subassembly" includes a vertically extending metal partition for separating the air conditioning unit into indoor and outdoor sections. The second subassembly further includes a motor driving both condenser and evaporator fans as well as evaporator and condenser shrouds and an electrical control box. The second subassembly is vertically lowered into mating cooperation with the second subassembly and the partition and condenser shroud are suitably attached to the basepan with threaded fasteners.

It is deemed desirable to have a one-piece molded plastic basepan, which facilitates assembly of the subassemblies of such an air conditioning unit while providing for a high level of structural integrity.

SUMMARY OF THE INVENTION

A molded plastic basepan supporting components of a room air conditioner includes a substantially rectangular bottom wall having a front edge, a back edge and left and right side edges. The bottom defines a top surface and bottom surface, and each of the edges thereof includes a structural side wall section extending upwardly therefrom in a direction substantially perpendicular to the bottom wall. A vertically extending substantially hollow structural beam is formed in the bottom wall of the basepan. The structural beam extends laterally from a location proximate the left side wall to a location proximate the right side wall. In a preferred embodiment, the bottom surface of the bottom wall is substantially planar and the structural beam is defined by a closed elongated channel extending upwardly into the basepan to define an elongated enclosed wall extending upwardly from the top surface of the bottom wall.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
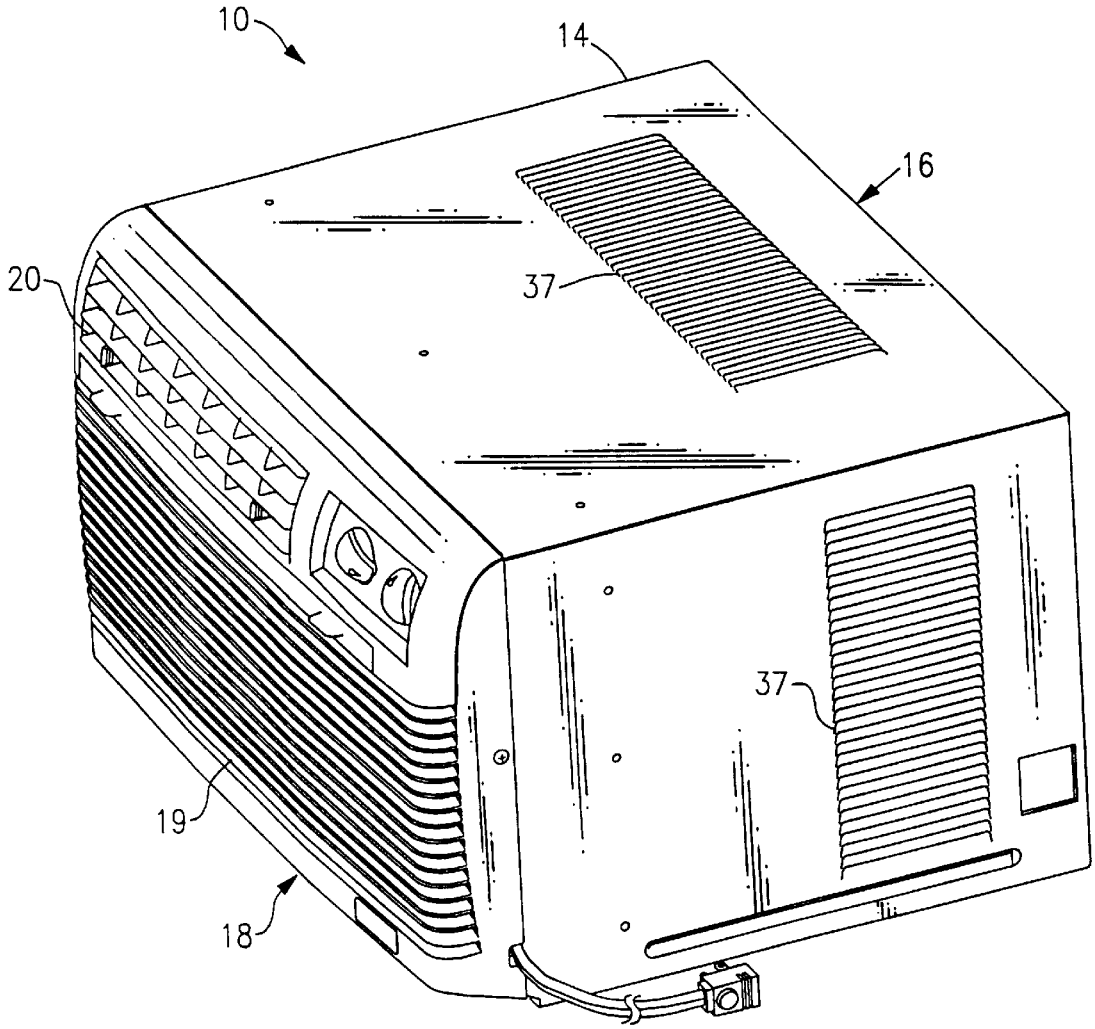
FIG. 1 is a perspective view of a room air conditioner, which embodies the features of this invention.
Figure 2:
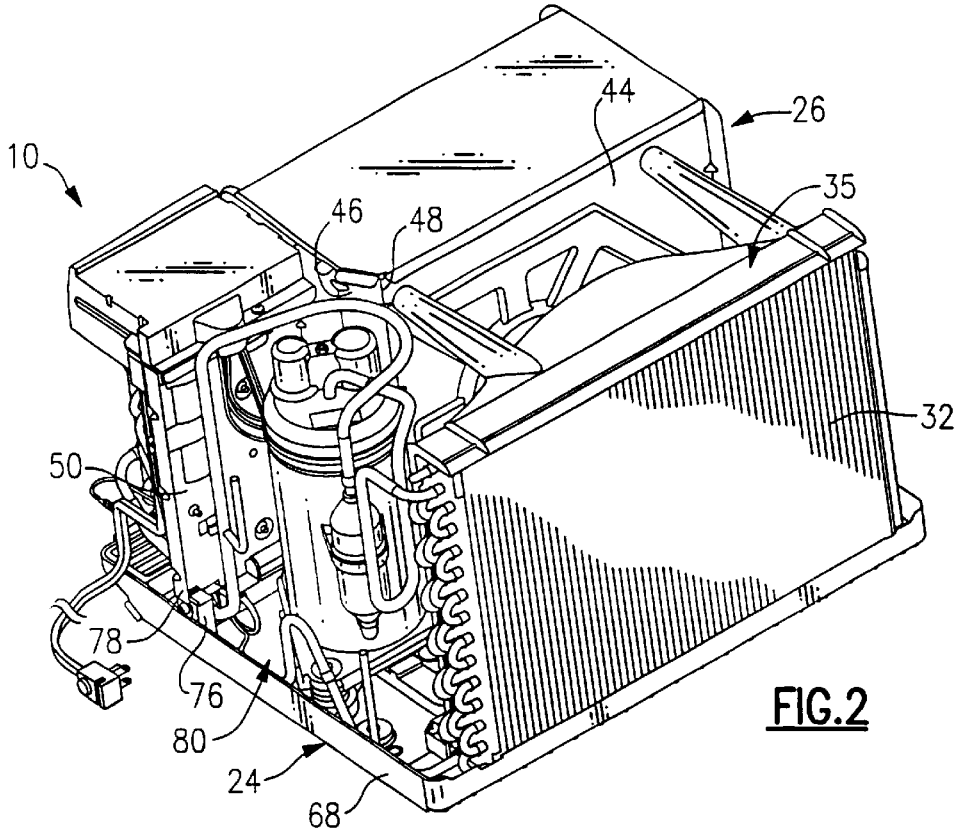
FIG. 2 is a rear perspective view of the air conditioner unit of FIG. 1 with the housing and front grille removed therefrom.

FIG. 1 illustrates a room air conditioner unit 10 which includes generally an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 19 and an air discharge assembly 20.

Looking now at FIGS. 2–4, 7 and 12, the components of both the indoor section 12 and outdoor section 14 are supported in a rectangular basepan 24. The indoor and outdoor sections are separated by a vertically extending metal partition 26. The indoor section comprises basically an evaporator coil 28 vertically disposed at the front end thereof, an evaporator or indoor fan 30 located behind the evaporator 28 and an air directing scroll 29.

The outdoor section 14 includes a condenser coil 32 vertically disposed adjacent the back end thereof, a condenser fan 34, located adjacent the condenser coil, and a condenser fan orifice shroud 35. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed by the scroll 29 back into the room to be cooled through the air discharge assembly 20. At the same time, ambient air is drawn through inlets 37 in the outside section of the housing 16 and through the orifice 38 in shroud 35, by operation of the condenser fan 34, and is directed through the condenser coil 32 before exiting from the backside of the condenser coil.

As described in the previously referenced U.S. patent application Ser. No. 09/140,007, which application is hereby incorporated herein in its entirety by reference thereto, all of the components of the air conditioning unit 10 which are contained within the housing 16 and the indoor grille 18 are assembled in two major subassemblies, which are then easily assembled to one another prior to installation of the housing 16 and the indoor grille 18 to complete assembly of the unit.

As best seen in FIGS. 2–4 and 12, when the subassemblies referred to above are installed to the basepan 24, the lower edge 40 of the partition 26 is received in mating structure which has been integrally molded into the basepan. Also, the lower edge 42 of the condenser fan shroud 35 is received in mating structure formed in the basepan. While the mating structures referred to above serve to receive and position the partition 26 and the condenser shroud 35, the structures are also principal structural components of the basepan 24.

Figure 3:
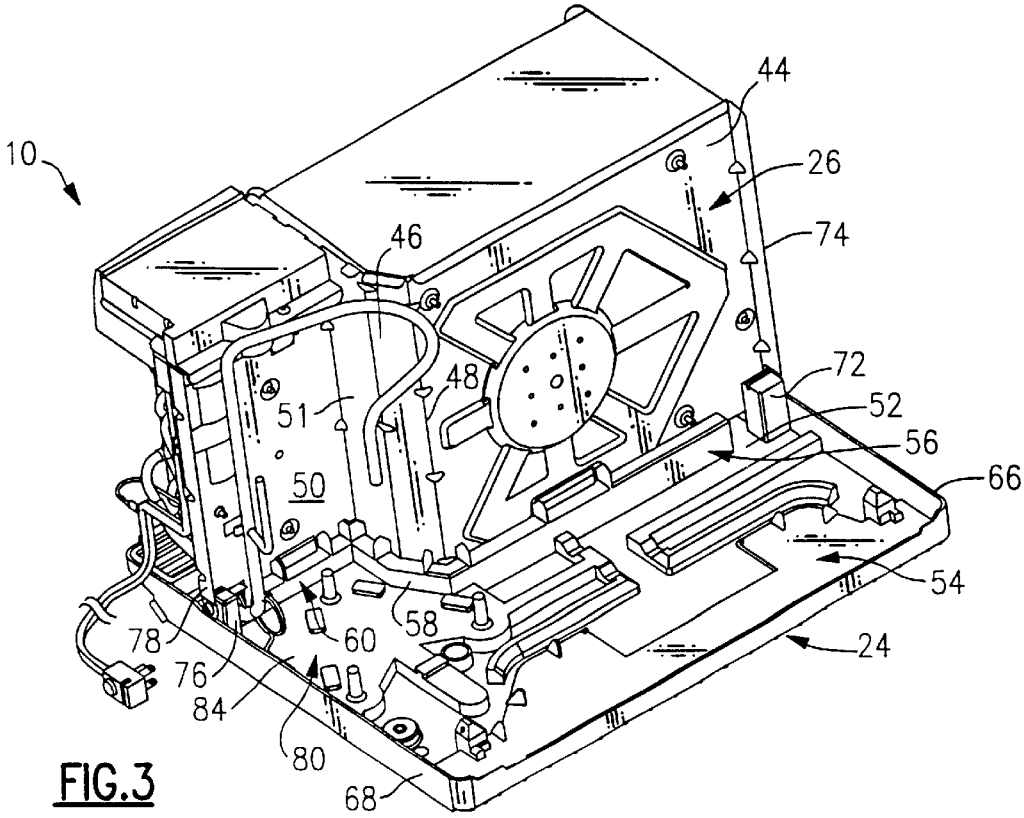
FIG. 3 is a view similar to FIG. 2 with a number of components of the outside section removed therefrom to show details of the invention.
Figure 4:
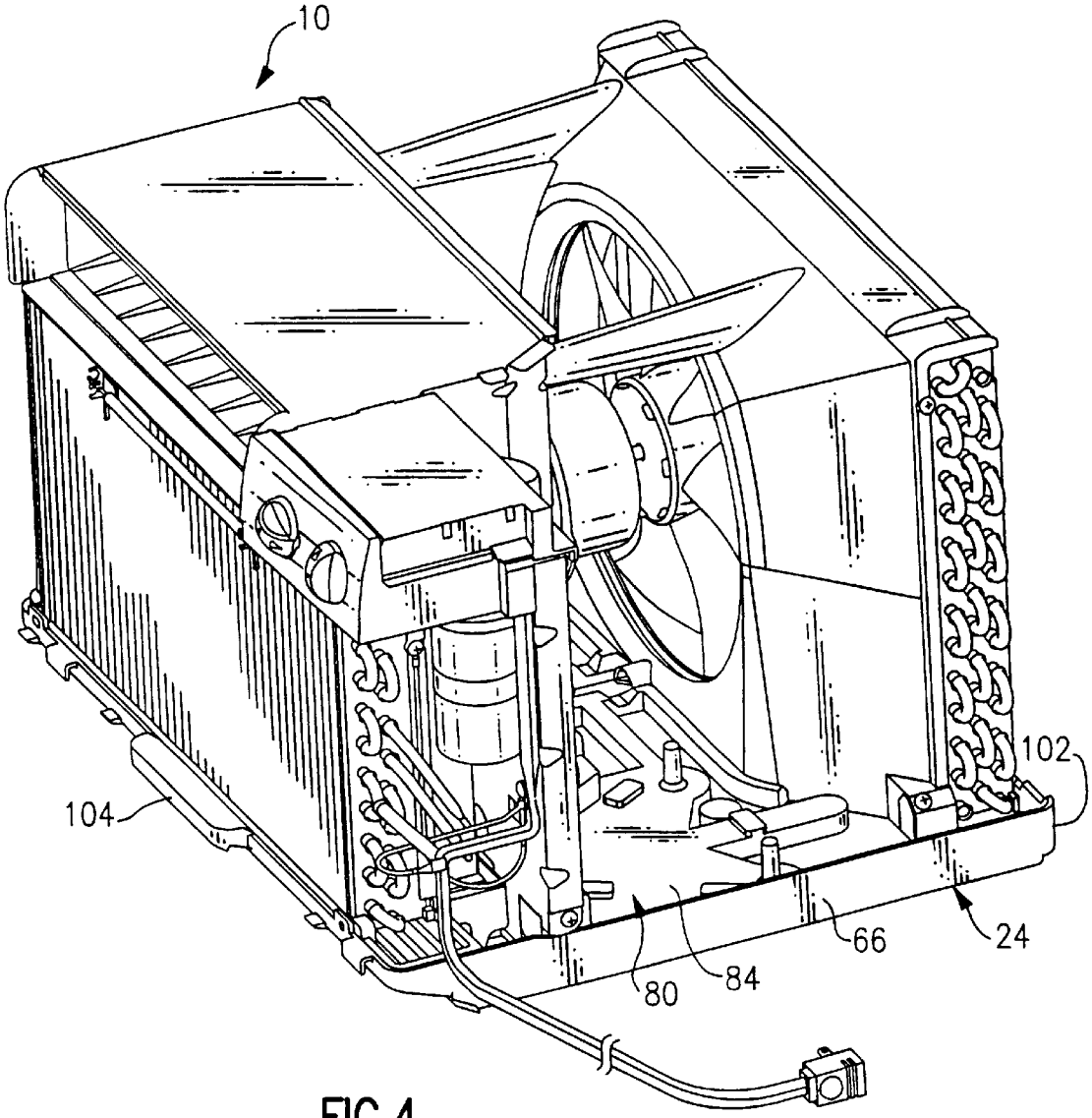
FIG. 4 is a front side perspective view of the air conditioning unit of FIG. 1 with the housing front grille and compressor removed therefrom.
Figure 5:
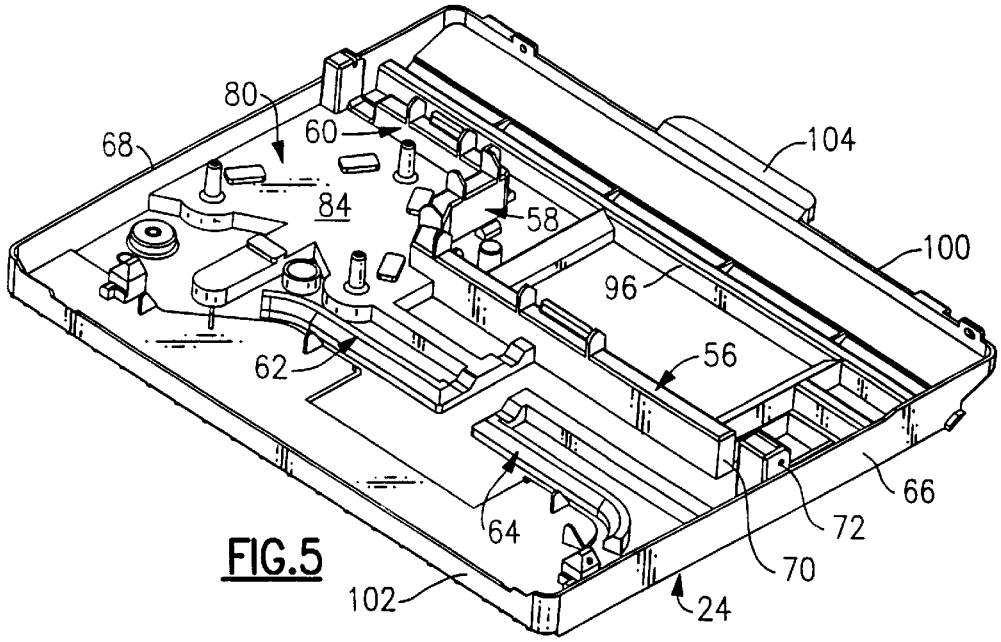
FIG. 5 is a left side rear perspective view of the basepan according to the present invention.
Figure 6:
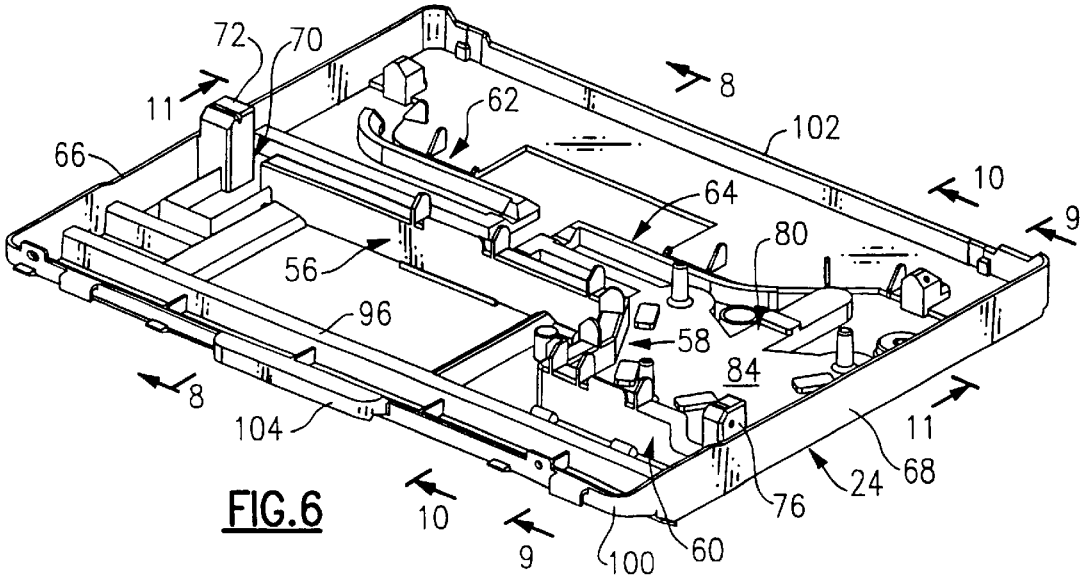
FIG. 6 is a front right side perspective view of the basepan according to the present invention.

As best seen in FIG. 3, partition 26 comprises three vertically extending wall sections, a main section 44, an intermediate section 46 extending forwardly from the right-hand edge 48 of the main section 44, and a right-hand section 50, which extends from the right front edge 51 of the intermediate section in an orientation spaced forwardly and substantially parallel to the main section 44. It should be understood that FIG. 3 is a rear view of the unit and the left and right-hand sections described above are with reference to the unit as viewed in FIGS. 4 and 12 from the front thereof.

Again, as best seen in FIG. 3, the lower end of each of the three partition sections, 44, 46 and 50 is adapted to engage the top surface 52 of the bottom wall 54 of the basepan 24. Further the lower vertical wall portions of each of the partition sections are received in confronting relation with three wall sections 56, 58 and 60 associated with the main 44 intermediate 46 and right-hand 50 partition sections.

In a like manner, the lower edge 42 of the condenser shroud 35 is received and positioned by a pair of elongated upstanding wall sections 62 and 64. The details of the engagement between the partition and the structural wall (56, 58, 60) and the condenser shroud 35 and the structural walls (62, 64) will not be described in further detail herein. Such cooperation forms the subject of a separate invention described in detail in U.S. patent application Ser. No. 09/641,234 entitled "Air Conditioner Structure" filed on even date herewith.

Looking now at the basepan only and with reference to FIGS. 5–11, the structural wall sections 56, 58 and 60 are interconnected and define a closed elongated channel extending upwardly into the basepan to define on the upper side of the basepan a continuous elongated structural beam which extends from a location proximate the left side wall 66 of the basepan to a location proximate the right side wall 68 of the basepan 24. These hollow beams are formed during the molding process by providing appropriately sized core elements in the basepan mold.

It will be noted that there is a discontinuity 70 in the structural wall 56 adjacent the left side wall 66. This discontinuity 70 is part of the condensate disposal system and allows for passage of condensate from the inside section of the basepan to the outside section. To the left of the discontinuity 70 is a vertically extending boss 72 which is integrally formed with the left side wall 66 and forms an attachment point for the left edge 74 of the partition 26 thereto. Adjacent the right-hand end of the right hand structural wall section 60 is another upstanding boss 76, which similarly provides an attachment point for the right edge 78 of the partition.

Figure 7:
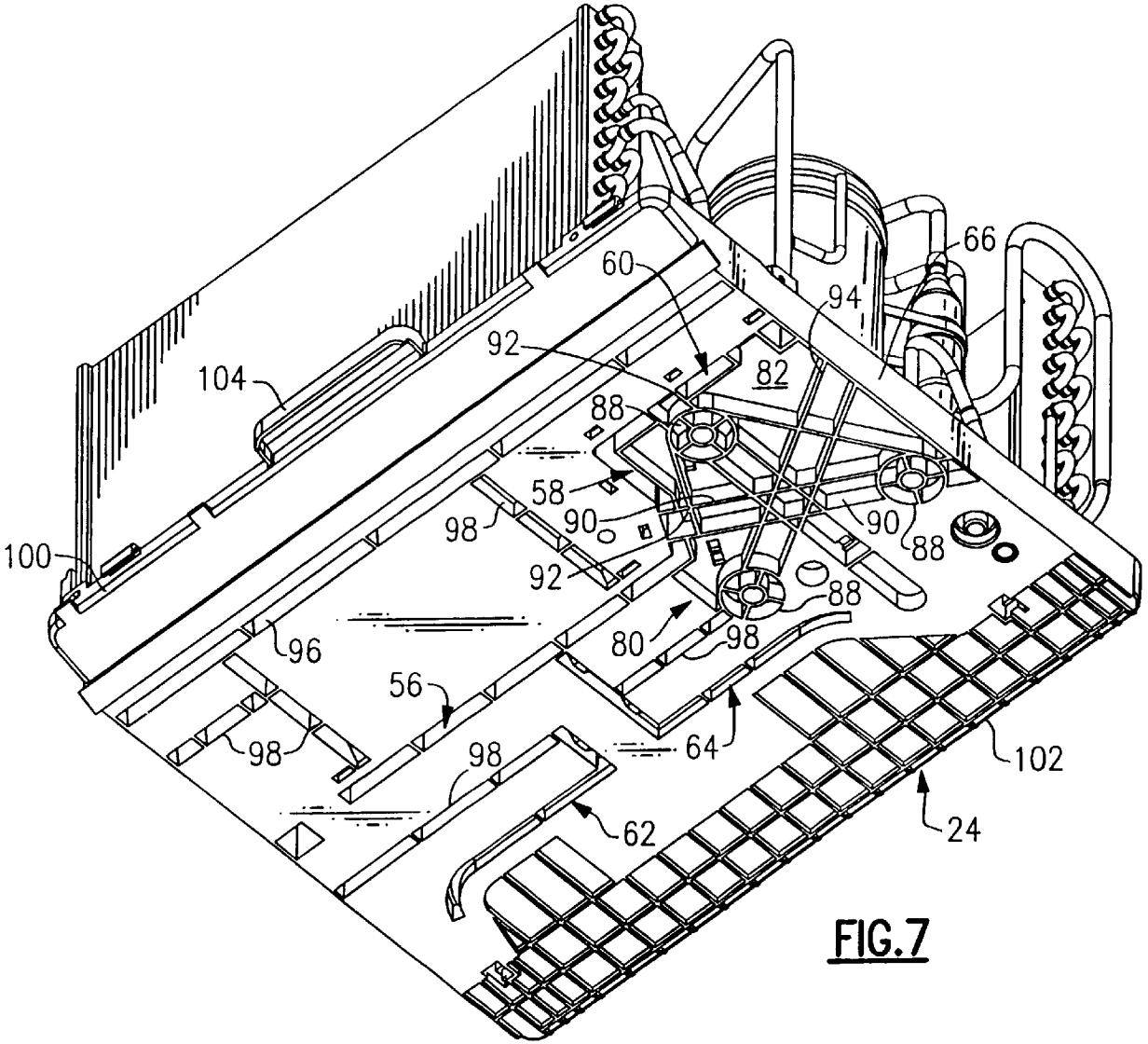
FIG. 7 is a bottom, front right side perspective view of the air conditioning unit illustrated in FIG. 2.

As best seen in FIG. 7, a compressor support structure 80 is formed in the basepan adjacent the right side wall 66. The compressor support structure is defined by a section of the bottom wall 54 of the basepan wherein the top surface 52 and the lower surface 82 are raised to define an upwardly facing compressor support surface 84 on the raised section of the upper surface. The compressor support structure further includes an array of structural ribs formed in the lower surface of the raised section, which extend downwardly therefrom. The array of structural ribs include three circular formations 88 and a plurality of longitudinally extending ribs 90. The circular formations and longitudinal ribs are tied into the structural wall sections 56 and 58 by rib sections both bearing reference numeral 92. The circular formations 88 underlie and are structurally interconnected with the compressor support studs 89 which extend vertically upwardly from the compressor support surface 84. As a result of this interconnection, the structural integrity of the compressor support as well as the structural wall sections 58 and 60 are enhanced. Further, it should be noted that the longitudinal ribs 90 are tied into the right-hand side wall 66 at locations identified by reference numeral 94 further enhancing the structural rigidity of the compressor support 80.

Figure 8:
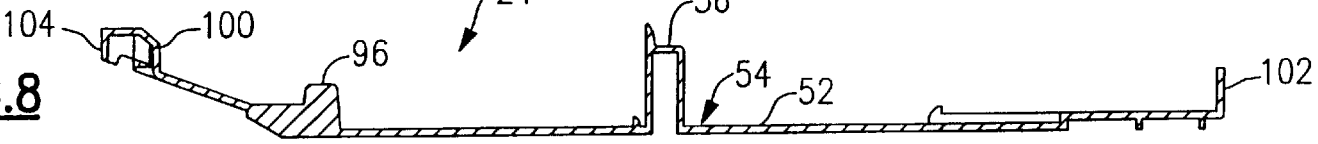
FIG. 8 is a sectional view taken to the line 8—8 in FIG. 6.
Figure 9:
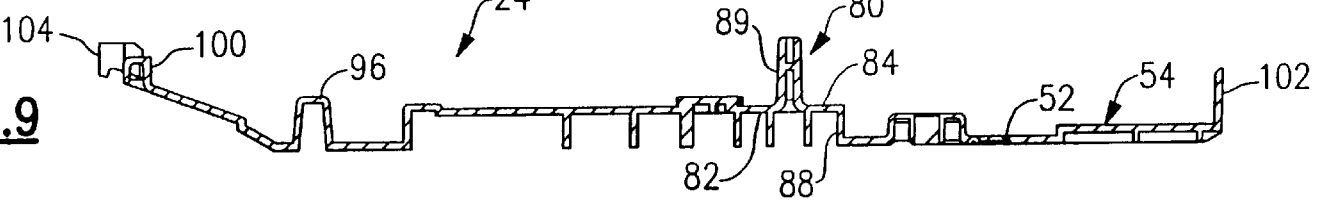
FIG. 9 is a sectional view taken to the line 9—9 in FIG. 6.
Figure 10:
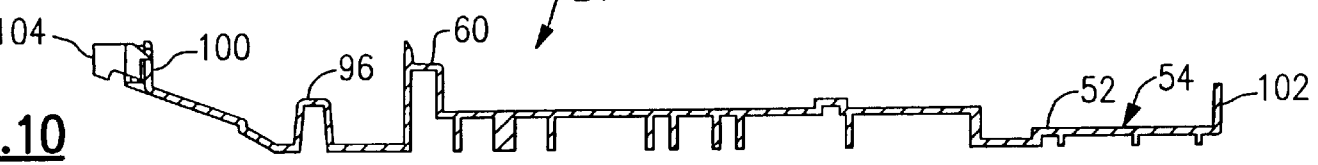
FIG. 10 is a sectional view taken to the line 10—10 in FIG. 6.
Figure 11:
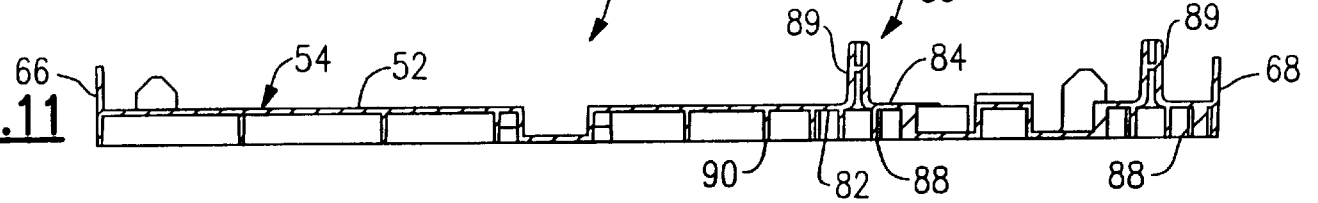
FIG. 11 is a sectional view taken to the line 11—11 in FIG. 6.
Figure 12:
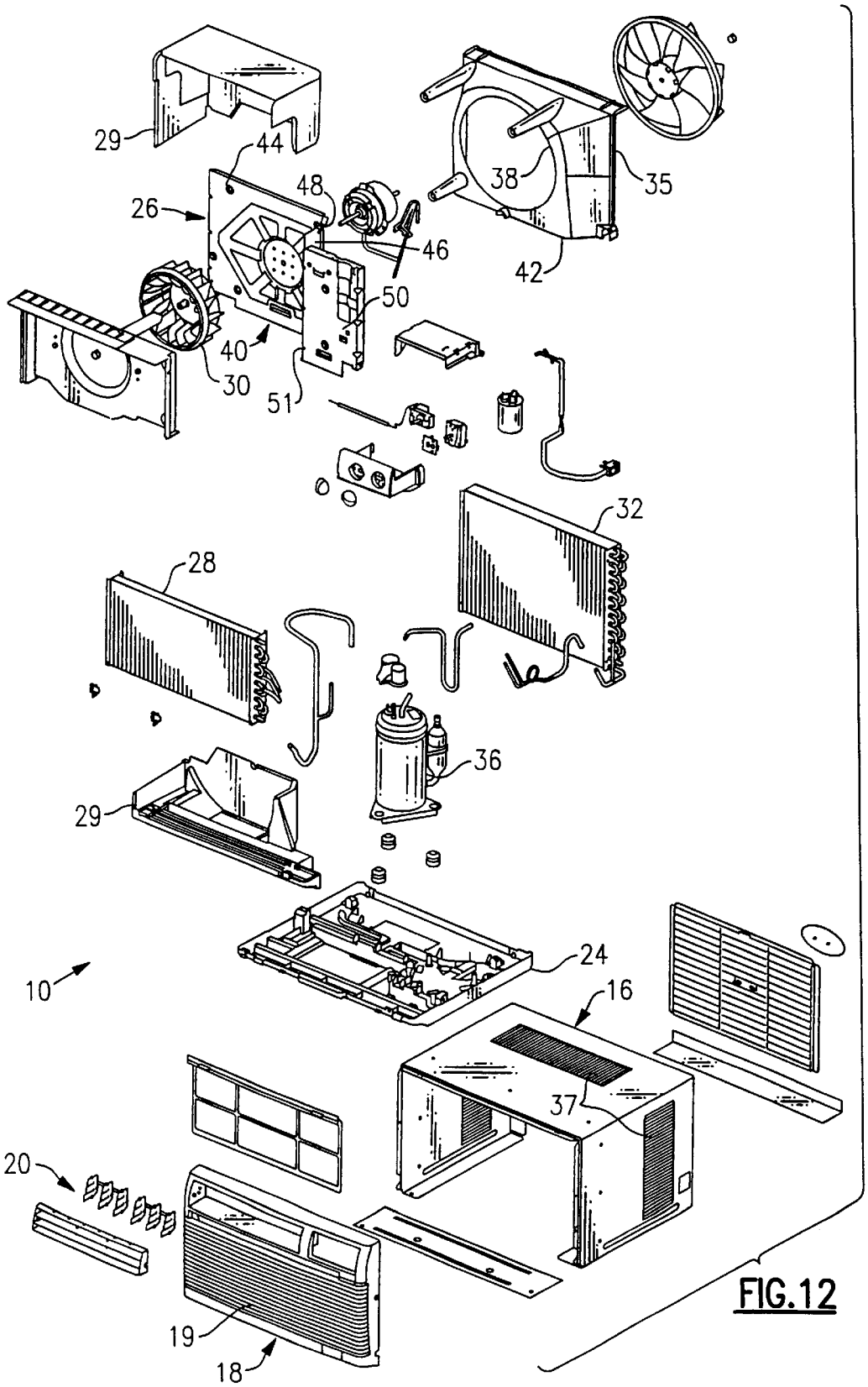
FIG. 12 is an exploded perspective view of the air conditioner illustrated in FIG. 1.

As is best seen in FIGS. 8 and 10, the hollow structural wall formed by the three segments 56, 58 and 60 defines the support wall having the greatest depth and thereby makes the greatest contribution to the structural integrity of the basepan. Hollow walls formed by the condenser shroud walls 62 and 64 are seen in longitudinal section in FIG. 11 and a front support beam 96, which is formed in a like manner extends across the front of the basepan from the left side wall 68 to the right side wall 66.

As best seen in FIG. 7, a number of other hollow structural walls bearing reference numeral 98, generally, extend both laterally and transversely to the basepan structural and contribute to the overall structural integrity of the basepan. All of these structural walls are formed in the same manner as the walls 56–64.

Structural integrity of the basepan is also enhanced by vertically extending rear wall and vertically extending front wall 100 and 102, respectively. Integrally formed with the front wall 102 is a structural handle 104, which facilitates installation and removal of the basepan with its assembled components into the outer housing.

What is claimed is:

1. A molded plastic basepan for supporting components of a room air conditioner comprising:

a substantially rectangular bottom wall having a front edge, a back edge and left and right side edges, said bottom wall further defining a top surface and a bottom surface;

each of said edges having a structural side wall section extending upwardly therefrom in a direction substantially perpendicular to said bottom wall;

a substantially hollow structural beam formed in said bottom wall, said structural beam extending from a location proximate said left side wall section to a location proximate said right side wall section.

2. The molded plastic basepan or claim 1 wherein said bottom surface of said bottom wall is substantially planar and said structural beam is defined by a closed elongated channel extending upwardly into said basepan to define an elongated enclosed wall extending upwardly from said top surface of said bottom wall.

3. The molded plastic basepan of claim 2 further including compressor support structure formed adjacent one of said side walls, said compressor support structure comprising a section of said bottom wall having said upper surface and said lower surface raised to define an upwardly facing compressor support surface on said raised section of said upper surface, said compressor support structure further including an array of structural ribs formed in the lower surface of said raised section which extend downwardly therefrom.

4. The molded plastic basepan of claim 3 wherein said array of structural ribs include three or more circular formations and a plurality of longitudinally extending ribs interconnecting one or more of said circular formations to one another or to said structural beam.

5. The molded plastic basepan of claim 4 further including one or more additional substantially hollow structural beams formed in said bottom wall, each of said one or more additional structural beams defining an enclosed wall extending upwardly from said top surface of said bottom wall.

6. The molded plastic basepan of claim 5 wherein said enclosed downwardly extending walls formed by said structural beams are positioned and configured to cooperate with other components of a room air conditioner.

7. The molded plastic basepan of claim 1 further including a structural handle integrally formed in said structural side wall extending from said first edge of said bottom wall.

* * * * *